US005168850A

United States Patent [19]

Zentgraf et al.

[11] Patent Number: 5,168,850

[45] Date of Patent: Dec. 8, 1992

[54] LOAD ADJUSTMENT DEVICE

[75] Inventors: Matthias Zentgraf, Frankfurt am Main; Gerd Hickmann, Schwalbach/Ts., both of Fed. Rep. of Germany

[73] Assignee: VDO Adolf Schindling AG, Frankfurt am Main, Fed. Rep. of Germany

[21] Appl. No.: 688,902

[22] Filed: Apr. 19, 1991

[30] Foreign Application Priority Data

May 7, 1990 [DE] Fed. Rep. of Germany ..... 4014508

[51] Int. Cl.[5] ..... F02D 11/10

[52] U.S. Cl. ..... 123/399; 123/361; 123/339

[58] Field of Search ..... 123/361, 399, 400, 339, 123/494

[56] References Cited

U.S. PATENT DOCUMENTS

| | | | |
|---|---|---|---|
| 4,137,517 | 1/1979 | Garcea | 123/399 |
| 4,279,228 | 7/1981 | Mann | 123/357 |
| 4,787,353 | 11/1988 | Ishikawa | 123/400 |
| 4,896,640 | 1/1990 | Pfalzgraf | 123/399 |
| 4,922,177 | 5/1990 | Mausner | 123/399 |
| 5,016,589 | 5/1991 | Terazawa | 123/399 |
| 5,027,766 | 7/1991 | Zentgraf | 123/399 |

*Primary Examiner*—Carl S. Miller
*Attorney, Agent, or Firm*—Martin A. Farber

[57] ABSTRACT

A load adjustment device is provided with a throttle valve (9) which determines the output power of an internal combustion engine and is connected, fixed for rotation, to a throttle-valve shaft (32) which is mounted in the throttle valve housing (30). The throttle-valve shaft (32) has an accelerator-pedal-side, mechanical articulation side and a setting-motor-articulation-side, with which there is associated a coupling element for the mechanical uncoupling of the throttle valve from an electric motor (14), as well as means for reporting the instantaneous position of a throttle-valve lever (21) arranged on the throttle-valve shaft (32) and of a driver element (25) to an electronic control device (17). The report device has a first transmission member which is arranged fixed for rotation on the throttle-valve shaft (32) and cooperates with a first potentiometer (23) as well as a second transmission member which is mounted for free rotation on the throttle-valve shaft (32) and cooperates with a second potentiometer (24). All parts of the device for the reporting are arranged in a dust-protected housing (36) so that a very compact arrangement is obtained.

9 Claims, 3 Drawing Sheets

LOAD ADJUSTMENT DEVICE

FIELD AND BACKGROUND OF THE INVENTION

A load adjustment device has a throttle valve which determines the output of an internal combustion engine and is connected fixed for rotation with a throttle-valve shaft mounted in the throttle valve housing. The throttle-valve shaft has a mechanical articulation side on the side of the accelerator, a setting-motor articulation side, with which there is associated a coupling element for the mechanical uncoupling of the throttle valve from a setting motor, as well as means for reporting the instantaneous position of the throttle-valve shaft to an electronic control device.

In such a load adjustment device, the control of the throttle valve is customarily effected on the accelerator-pedal side via a driver which is connected with the articulation side of the throttle-valve shaft and is connected for this purpose by means of a Bowden cable to the accelerator pedal. Under certain conditions of travel, for instance in the case of speed control or idle control, the control of the throttle-valve shaft is effected by an electric setting motor which is associated with the load adjustment device. This is preceded by a mechanical adjustment effected by the driver of the car. For this reason, it is mechanically necessary to uncouple the throttle valve from the electric setting motor for certain angular ranges. As a result of this uncoupling it is necessary for the quality of the control of the load adjustment device to report the position of the electrical setting motor. The detection of this position is effected by the report means which is associated with a control device. However, in order to provide standardization it is desirable that a specific part of the device which actually electrically detects the position of the setting motor be associated with the reporting device on the accelerator-side mechanical articulation-side of the load adjustment device.

SUMMARY OF THE INVENTION

In contradistinction to this, it is an object of the present invention so to develop a load adjustment device that all parts essential for the report device can be arranged in a space-saving and well-protected manner.

According to the invention, the reporting device has a first transmission member arranged, fixed for rotation, on the throttle-valve shaft (32) and cooperating with a first potentiometer (23), and, alongside of it, a second transmission member which is mounted for free rotation on the throttle-valve shaft (32) and cooperates with a second potentiometer (24). In this way, a very cost-efficient, space-saving arrangement of all essential parts of the reporting device has been arranged on the throttle-valve shaft. This is obtained, in particular, in the manner that the two potentiometers and the corresponding transmission members are arranged alongside of each other.

This is obtained in advantageous fashion in the manner that the transmission member arranged fixed for rotation on the throttle-valve shaft (32) is developed as a throttle-valve lever (21) which is in contact, via a wiper driver (22), with the first potentiometer (23), all parts being arranged in a housing. The arrangement of the potentiometers, wiper drivers and transmission members in a single housing assures good protection against damage and dirt.

In accordance with the invention, the second transmission member, which is mounted for free rotation on the throttle-valve shaft (32), is developed as driver element (25) having at least one stop (46) against which the throttle-valve lever (21) can be brought to rest. The driver element is in contact via a second wiper driver (37) of the second potentiometer (24), which is arranged in the same plane as the first potentiometer. In this way, a very compact arrangement in a very small space is obtained.

As a further development of the invention, it is advantageous for the second driver element (25) to have a free-travel segment (27) with at least one stop (46) in which the throttle-valve lever (21) is adjustable, and that the driver element (25) on the setting-motor articulation side be connected for drive via a transmission element with an electric motor (14) which can be controlled via a control device (17). By the stop provided in the driver element, assurance is had that the throttle-valve lever is displaced within the idle-control range. By means of the second potentiometer, the corresponding desired-value in information is forwarded via the actual-value detection device to the control device and thereby controls the electric motor for displacement of the throttle valve until the throttle valve is set at the desired value, which is then compared with the actual value determined by the first potentiometer. If the accelerator lever and thus the throttle-valve lever are displaced, the driver element remains in its position, since the throttle-valve lever can move freely due to the advantageous arrangement.

One advantageous embodiment of the invention provides that the driver element (25) is connected for drive on the setting-motor articulation side via a transmission element with an electric motor (14) which can be controlled via a control device (17). In this way, a drive connection is obtained in simple manner between the throttle-valve shaft and the electric motor.

As a further development of the invention, it is advantageous that the accelerator pedal (1) be connected directly or indirectly via a desired-value lever (39) which is freely swingable in a defined range on the throttle-valve shaft (32) with the throttle-valve lever (21). Furthermore a free-travel hook (40) is arranged, fixed for rotation on the throttle-valve shaft (32). The hook 40 is in a free-travel segment (41) provided in the desired-value lever (39) and being brought via a return spring (42) to rest against a stop (26) which limits the free-travel segment (41). The hook is connected for drive via the throttle-valve shaft (32) with the throttle-valve lever (21). The return spring (42) acts by means of the lever arm (44) on the throttle-valve shaft (32) and, for reasons of safety, pulls the latter in the direction of closing. By the arrangement of the actual-value potentiometer throttle valve and of the actual-value potentiometer idle control range in a plane, as well as by the space-saving arrangement of the throttle-valve lever and of the driver in a dust-protected housing, a very compact setting member is obtained. Furthermore, the desired-value lever can be used as throttle-valve drive lever and for the idle control operation.

A very space-saving arrangement is also obtained in the manner that the two potentiometers (23, 24) are arranged in a common plane.

BRIEF DESCRIPTION OF THE DRAWING

With the above and other objects and advantages in view, the present invention will become more clearly understood in connection with the detailed description of a preferred embodiment, when considered with the accompanying drawing, of which.

DETAILED DESCRIPTION OF THE PREFERRED EMBODIMENT

Figure 1:
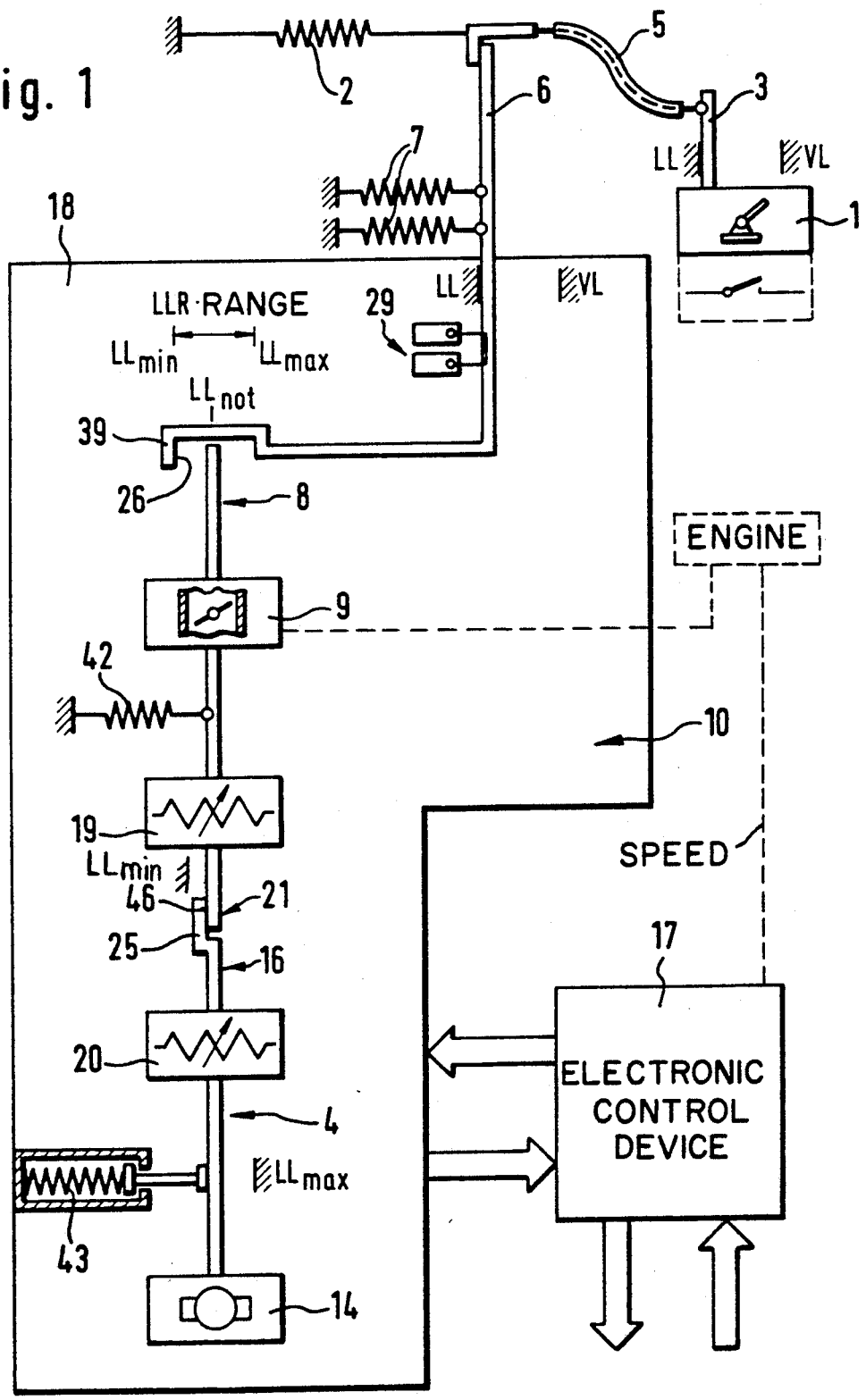
FIG. 1 is a block diagram showing the basic function of the load adjustment device of the invention.

The parts shown within the frame 18 in FIG. 1 form a setting member or a load adjustment device 10, the parts being assembled in a single structural unit. The load adjustment device 10 includes a setting motor or electric motor 14, which is connected to drive a throttle valve 9 via a transmission 4, indicated only diagrammatically. Via the transmission 4, setting forces of the electric motor 14 are transmitted to the throttle valve 9 whereby displacement of the valve 9 into the desired position is brought about.

As can be noted from FIG. 1, the load adjustment device 10 can be displaced via an accelerator pedal 1, a lever 3 being displaced and urged in idle direction LL via a return spring 2 upon release of the accelerator pedal 1. The accelerator pedal 1 is connected by a cable 5, such as a Bowden cable, to a driver 6 so that, upon actuation of the accelerator pedal 1, the driver 6 is shifted in the direction towards the full load stop VL for delivery of gas to an internal combustion engine. The return springs 7, which urge the driver 6 into the idling direction LL, are present on the driver 6. As long as the gas cable 5 is not actuated, the driver 6 lies against the idle stop LL associated with it. By the stationary arrangement of the spring 42, a direct return of the throttle valve 9 is achieved. The function of the spring 42 is described in further detail below and shown in FIG. 2.

The load adjustment device 10 has, in addition to the first control element part 8, a second control element part 16, which is connected to the electric motor 14. The control element part 16 is also indicated diagrammatically in FIG. 1, and may include a transmission, not shown in the drawing. The two control element parts 8 and 16 are not rigidly connected to each other but can be coupled only in one direction of movement, namely in the upward control direction.

In FIG. 1, an electronic control device 17, which contains preparation, logic and control switches, is indicated diagrammatically. In its digital part, the control device 17 stores values for the adaptation of the vehicle, and processes the digital or digitalized values of different input variables which then control the desired position of the throttle valve 9 via an analog part. With the electronic control device 17 there cooperates an actual-value detection device 19, which forms part of the control element part 8, as well as an actual-value detection device 20 which is associated with the second control element part 16 and determines the instantaneous position of the control element part 16.

Figure 2:
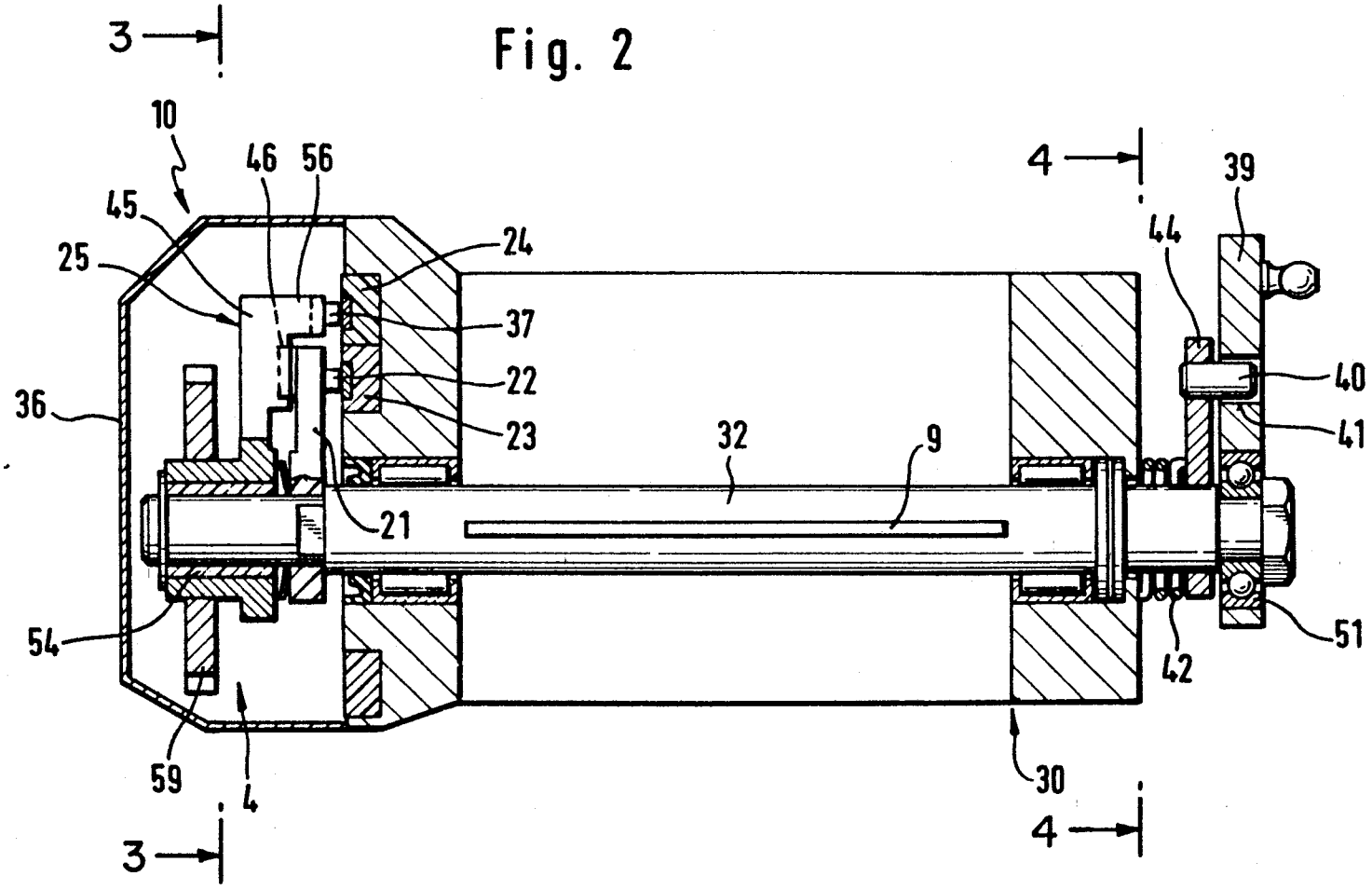
FIG. 2 is a longitudinal cross section through the setting member with the corresponding throttle-valve shaft.
Figure 3:
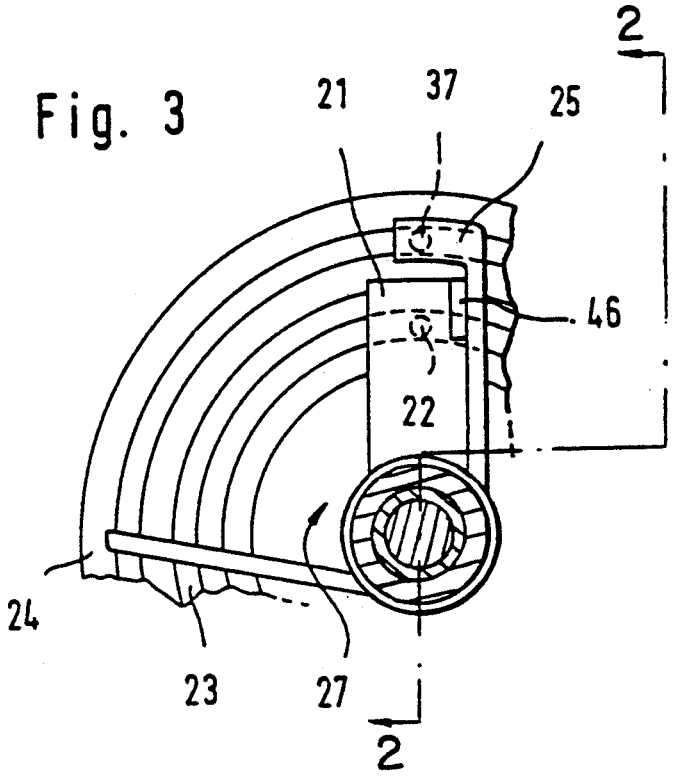
FIG. 3 shows a throttle-valve lever arranged on the throttle-valve shaft and a driver also arranged on the throttle-valve shaft.

The first actual-value detection device 19, in accordance with FIG. 1, comprises a first potentiometer 23, and the second actual-value detection device 20 comprises a second potentiometer 24 shown in FIGS. 2 and 3.

The purpose of the control device 17 is to detect all signals which are inputted, for instance, the actual engine speed, and the desired engine speed of rotation by means of the potentiometers 23, 24 (FIG. 2), and compare them with each other. If, for instance, the actual speed of rotation differs from the desired speed of rotation, then the setting member is controlled until the predetermined speed of rotation has been set.

In addition, via an idle contact 29, which is activated by the driver 6, signals are detected by the electronic control device 17 when the driver comes to rest against the idle stop LL associated with it.

The electronic control device 17, in combination with the actual-value detection device 19 or 20 and the external reference variables, serves the purpose of developing a safety logic with respect to the control of the first and second control element parts 8,16. As soon as the electronic control device 17 or the electric motor 14 no longer operates dependably, the throttle valve 9 is moved into the idle emergency position $LL_{not}$ by the spring 43, which urges in the direction towards maximum idle position.

Figure 4:
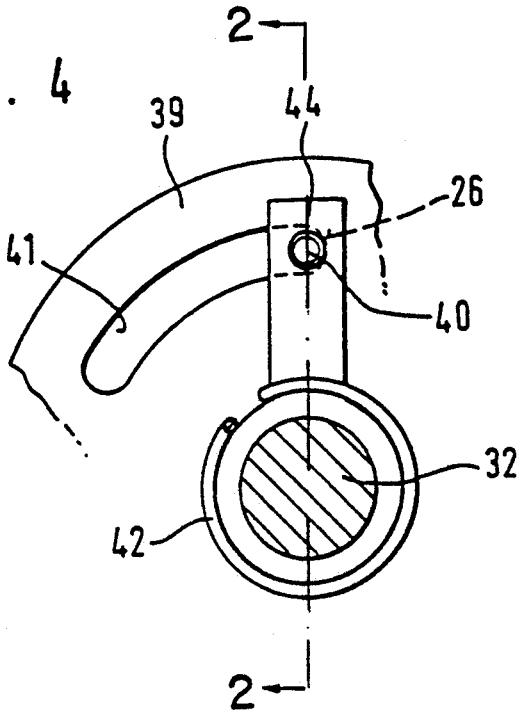
FIG. 4 shows a driver element with a free-travel segment.

In FIGS. 2 and 3 the setting member 10, which has been shown only diagrammatically within the frame 18 in FIG. 1, is shown in detail. The setting member 10 comprises a throttle valve housing 30 in which a throttle-valve shaft 32 having a throttle valve 9 is arranged. On the accelerator pedal-side mechanical articulation side, a desired-value lever 39 is supported on the end of the throttle-valve shaft 32 by means of an antifriction bearing 51 for free rotation within a defined range. The desired-value lever 39 has a free-travel segment 41 (FIG. 4), which serves to receive a free-travel hook 40, which is arranged fixed on a lever arm 44. The setting forces which proceed from the accelerator pedal 1 are transmitted via the desired-value lever 39 and the free travel hook 40 to the throttle-valve shaft 32. If the throttle-valve shaft 32 is displaced within the idling control range via the electric motor 14, then the free travel hook 40 can move freely within the free-travel segment 41. The desired-value lever 39 is furthermore in drive connection via the free-travel hook 40 on the setting motor articulation side of the throttle-valve shaft 32 with a throttle-valve lever 21 which is connected, fixed for rotation, with the throttle-valve shaft 32. On the surface of the throttle-valve lever 21 which is directed towards the throttle valve there is a first wiper driver 22, which is in contact with a first potentiometer 23. The throttle valve 9 can move freely when the desired-value lever 39 rests against the stop or idle stop 46. The potentiometer 23 and the wiper driver 22 are diagrammatically indicated in FIG. 1 by the actual-value detection device 19, which forwards the actual-value position of the throttle-valve shaft 32 a signal to the control device 17.

Closely alongside the throttle-valve lever 21 there is a free-travel bell 45, which is developed as driver element 25 and is mounted for free rotation by means of a plain bearing 54 on the throttle-valve shaft 32 and has, on its upper end, an arm 56, which engages over the upper end of the throttle-valve lever 21. On the arm 56, there is arranged a second wiper 37, which has contact with a second potentiometer 24. The second potentiometer 24 and the wiper 37 are diagrammatically indicated in FIG. 1 by the actual-value detection device 20, which forwards a corresponding signal for the idle control range to the control device 17. The driver or the free-travel bell 45 is provided with a cylindrical extension to receive a drive wheel 59, which can be operatively connected with the electric motor 14 via the transmission 4, shown diagrammatically in FIG. 1. Furthermore, the drive element 25 has a stop 46 against which the throttle-valve lever 21 is drawn by means of the return spring 42, so that the electric motor 14 can displace the throttle valve 9 for the idling control range via the driver element 25 and the throttle-valve lever 21. If the accelerator pedal 1 is actuated, then the electric motor 14 is deactivated so that the driver element 25 of the throttle-valve lever 21 can move freely within the free-travel segment 27. The throttle valve 9 is now displaced by means of the actual-value lever 39.

The two potentiometers 23, 24, the driver element 25, the throttle-valve lever 32, as well as the wiper drivers 22, 37 are contained in a closed housing 36 so that these parts are protected from dirt and damage. It is also advantageous for the two potentiometers 23, 24 to be arranged in one plane on two different circular paths, and for the driver element 25 and the throttle-valve lever 21 to be arranged close alongside of each other, so that all parts of the load adjustment device 10 can be arranged in the smallest possible space.

We claim:

1. A load adjustment device comprising;

a throttle valve housing and a throttle valve which determined the output of an internal combustion engine;

a throttle valve shaft mounted in the housing, the throttle valve being connected fixed for rotation with the throttle-valve shaft, there being an accelerator for adjusting fuel flow the engine, and the throttle-valve shaft having a mechanical articulation side on the side of the accelerator;

a coupling element and a setting-motor articulation side associated with the coupling element, the coupling element serving for a mechanical uncoupling of the throttle valve from a setting motor;

an electronic control device, and a reporting device for reporting an instantaneous position of the throttle-valve shaft to the electronic control device; and wherein the reporting device comprises a first potentiometer, a second potentiometer, and a first transmission member arranged, fixed for rotation, on the throttle-valve shaft and mechanically coupled to the first potentiometer, the first transmission member being developed as a throttle valve lever the reporting device further comprises a second transmission member disposed alongside the first transmission member and being mounted for free rotation on the throttle-valve shaft, the second transmission being mechanically coupled to the second potentiometer;

the load adjustment device further comprises a free-travel hook, a return spring and a return stop, and a lever arm extending from the throttle valve shaft;

there is a free-travel segment provided in the desired-value lever;

the free-travel hook is disposed for rotation on the throttle-valve shaft, said hook engaging in the free-travel segment of the desired-value lever and being brought via the return spring to rest against the return stop, the return stop limiting the free-travel segment; and the hook is connected for drive via the throttle-valve shaft with the throttle-valve lever, the return spring acting by means of the lever arm on the throttle-valve shaft and serving to pull the latter in a closing direction.

2. A load adjustment device according to claim 1, wherein the first potentiometer has a first wiper; and the throttle-valve lever is in contact, via the first wiper with the first potentiometer, the throttle valve lever and the first potentiometer being arranged in said housing.

3. A load adjustment device according to claim 1, wherein said second transmission member includes a driver element having at least one stop for receiving said throttle-valve lever, the driver element of said second transmission member contacting said second potentiometer via a second wiper of the second potentiometer; and the second potentiometer is arranged coplanar with the first potentiometer.

4. A load adjustment device according to claim 3, wherein the second driver element has a free-travel segment with at least one stop for engagement with the throttle-valve lever.

5. A load adjustment device according to claim 1, further comprising an electric motor; and wherein said second transmission member includes a driver element which is connected for drive on the setting-motor articulation side via said second transmission member with said electric motor, the motor being controllable by said control device.

6. A load adjustment device according to claim 1, further comprising a desired-value lever; and wherein the accelerator is connected via the desired-value lever to the throttle valve shaft, the desired-value lever being freely swingable in a defined range on the throttle-valve shaft with said throttle-valve lever.

7. A load adjustment device according to claim 6, further comprising a free-travel hook, a return spring and a return stop, and a lever arm extending from the throttle valve shaft; and wherein there is a free-travel segment provided in the desired-value lever;

the free-travel hook is disposed for rotation on the throttle-valve shaft, said hook engaging in the free-travel segment of the desired-value lever and being brought via the return spring to rest against the return stop, the return stop limiting the free-travel segment; and the hook is connected for drive via the throttle-valve shaft with the throttle-valve lever, the return spring acting by means of the lever arm on the throttle-valve shaft and serving to pull the latter in a closing direction.

8. A load adjustment device according to claim 1, wherein said first and said second potentiometers are arranged in a common plane.

9. A load adjustment device for an internal combustion engine comprising:

a throttle valve housing, a throttle valve, and a throttle valve shaft, the throttle valve being connected and fixed for rotation with the throttle valve shaft, the throttle valve shaft being rotatably mounted in the throttle valve housing, the throttle valve shaft having a first end and a second end opposite the first end;

a desired-value lever and a lever arm disposed rotatably about the throttle valve shaft, an accelerator for adjusting fuel flow to the engine, the accelerator being connected with the first end of the throttle valve shaft by the desired-value lever and the lever arm;

a first transmission member, a second transmission member, a drive wheel connected to the second transmission member, and a setting motor connected with the second end of the throttle valve shaft by the drive wheel and the first and the second transmission members, the drive wheel being rotatably mounted on the throttle valve shaft;

a return spring and an electronic control device; and a reporting device having first and second potentiometers fixed to the throttle valve housing for producing signals corresponding to positions of the first and the second transmission members;

wherein the desired-value lever has a free travel segment, the first potentiometer has a first wiper, and the second potentiometer has a second wiper;

the lever arm is fixed to the throttle valve shaft and is biased by the return spring in a closing direction of the throttle valve, the lever arm being rotatable relative to the desired-value lever along the free travel segment;

the first transmission member is developed as a throttle-valve lever which is fixed to the throttle valve shaft and in contact via the first wiper with the first potentiometer, the throttle-valve lever having a stop; and the second transmission member is developed as a driver element which is fixed to the drive wheel, and is in contact via the second wiper with the second potentiometer, the second transmission member interacting with the stop of the throttle valve lever to rotate the throttle valve lever in opening direction within a free travel segment which corresponds to the free travel segment of the desired-value lever.

* * * * *